US008517833B2

(12) United States Patent
Osgood

(10) Patent No.: US 8,517,833 B2
(45) **Date of Patent: *Aug. 27, 2013**

(54) GAME MACHINE AUDIO CONTROL USING A BACKEND SERVER

(75) Inventor: Paul R. Osgood, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/078,613

(22) Filed: Apr. 1, 2011

(65) Prior Publication Data

US 2012/0009995 A1 Jan. 12, 2012

Related U.S. Application Data

(63) Continuation of application No. 11/306,735, filed on Jan. 9, 2006, now Pat. No. 7,918,731.

(51) Int. Cl.
*A63F 9/24* (2006.01)

(52) U.S. Cl.
USPC ..... 463/35; 463/30; 463/42

(58) Field of Classification Search
USPC ..... 463/16–20, 35, 42
See application file for complete search history.

(56) References Cited

U.S. PATENT DOCUMENTS

| | | | | |
|---|---|---|---|---|
| 6,368,216 | B1 | 4/2002 | Hedrick et al. | |
| 6,868,162 | B1 | 3/2005 | Jubien et al. | |
| 2003/0017865 | A1 | 1/2003 | Beaulieu et al. | |
| 2003/0114214 | A1 | 6/2003 | Barahona et al. | |
| 2004/0029637 | A1 | 2/2004 | Hein, Jr. et al. | |
| 2004/0089140 | A1 | 5/2004 | Georges et al. | |
| 2004/0179701 | A1 | 9/2004 | Boyd | |
| 2005/0043090 | A1 | 2/2005 | Pryzby et al. | |
| 2005/0239545 | A1 | 10/2005 | Rowe | |
| 2008/0096666 | A1 | 4/2008 | Pryzby et al. | |
| 2008/0194319 | A1* | 8/2008 | Pryzby et al. | 463/25 |

* cited by examiner

*Primary Examiner* — Arthur O. Hall
*Assistant Examiner* — Steve Rowland
(74) *Attorney, Agent, or Firm* — Brooke Quist; Marvin Hein

(57) ABSTRACT

A system and method for providing centralized control of the audio output for one or more gaming machines in a casino gaming network are disclosed herein. The system comprises one or more microphone interfaces positioned in a casino gaming floor environment to obtain noise level data. The system also includes a system server connected to the one or more microphone interfaces to receive the obtained noise level data and to determine the appropriate audio output for one or more gaming machines. The system also includes an audio hub positioned within each gaming machine and connected to the system server, wherein each audio hub receives audio instructions from the system server and adjusts the audio output for one or more gaming machines.

25 Claims, 3 Drawing Sheets

GAME MACHINE AUDIO CONTROL USING A BACKEND SERVER

CROSS-REFERENCE TO RELATED APPLICATIONS

This application is a continuation of U.S. patent application Ser. No. 11/306,735, filed Jan. 9, 2006, which is herein incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Embodiments disclosed herein generally relate to a system and method for centrally controlling the audio output on one or more gaming machines in a casino gaming system.

Gaming machines have been developed with various components and features to enhance the gaming experience for casino patrons. For example, gaming machines include audio systems that provide music and sound effects to intensify the gaming experience by supplementing the visual effects of the gaming machine. Generally, these gaming machines may have audio systems that include one or more speakers, an amplifier, and a volume control.

Currently, gaming establishments control the audio levels of the individual gaming machines by manually adjusting the volume control in each gaming machine. This is a labor-intensive and inefficient process, especially for gaming establishments having thousands of gaming machines. Furthermore, this process is subject to human error because the volume controls are generally ungraduated volume knobs.

Furthermore, these audio systems are limited in the sound effects that may be provided by the gaming machine. That is, the gaming machine is only capable of producing those sound effects stored within the gaming machine. Additionally, the gaming machine is only capable of outputting the sound effects at pre-determined times or upon the occurrence of a predetermined event. Thus, the gaming machine is the sole arbiter of its sound effects, thereby making it difficult to change the sound output.

What is needed is a system and method that allows for the centralized control of audio output on a gaming device through a backend system. More particularly, what is needed is a system and method that allows for the uniform and simultaneous adjustment of multiple gaming machine volume levels, as well as audio effects triggered by the backend system.

SUMMARY

Briefly, and in general terms, various embodiments for controlling the audio output of one or more gaming machines from a central location are disclosed herein. One embodiment is directed to a system comprising one or more microphones positioned in a casino gaming floor environment to obtain noise level data. The system also includes a system server connected to the one or more microphones to receive the obtained noise level data and to determine the appropriate audio output for one or more gaming machines. The system also includes an audio hub positioned within each gaming machine and connected to the system server, wherein each audio hub receives audio instructions from the system server and adjusts the audio output for one or more gaming machines.

In another embodiment, the system comprises one or more noise level detectors positioned in a casino gaming floor environment to obtain noise level data. A microphone interface is connected to each of the one or more noise level detectors, wherein the microphone interface monitors the casino noise levels. The system server is connected to the microphone interface to receive the obtained noise level data and to determine the appropriate audio output for one or more gaming machines. The system also includes an audio hub positioned within each gaming machine and connected to the system server, wherein each audio hub receives audio instructions from the system server and adjusts the audio output for one or more gaming machines.

Methods for centrally controlling the audio output of one or more gaming machines in a casino game networking system are also disclosed herein. According to one method, noise level data is captured from a casino gaming floor. The captured noise level data is analyzed and the appropriate audio output for one or more gaming machines is determined. Instructions for adjusting the audio output are then sent to one or more gaming machines.

These and other features and advantages will become apparent from the following detailed description, taken in conjunction with the accompanying drawings, which illustrate by way of example, the features of various embodiments.

DETAILED DESCRIPTION

Various embodiments are directed to a system and method for centralizing the control of the audio output for one or more gaming machines. More particularly, the system provides a central location from which the sound levels of multiple gaming machines may be adjusted. For example, the system permits the audio levels on one or more gaming machines to be uniformly raised on a slow night to give the perception of a busy casino. Alternatively, the audio levels on one or more gaming machines may also be uniformly lowered. The centralized audio control system assists customers by allowing the casino to easily control the audio output. For example, on a busy night, the volume level may be simply adjusted so that cocktail waitresses and bartenders can hear customers. Alternatively, on a busy night, the volume may be increased so the casino patrons can better hear the games offered for play on the gaming machines. Additionally, the centralized audio control system allows the casino to simultaneously mute the audio output of multiple gaming machines during an emergency situation or, alternatively, allows the gaming machine to play an emergency message. Furthermore, the centralized audio control system provides for the creation of audio sound effects and sound types that may be played on the gaming machines. Accordingly, casino operators have the ability to alter the songs, melodies, sound effects, and various sound types emanating from multiple gaming machines.

Figure 1:
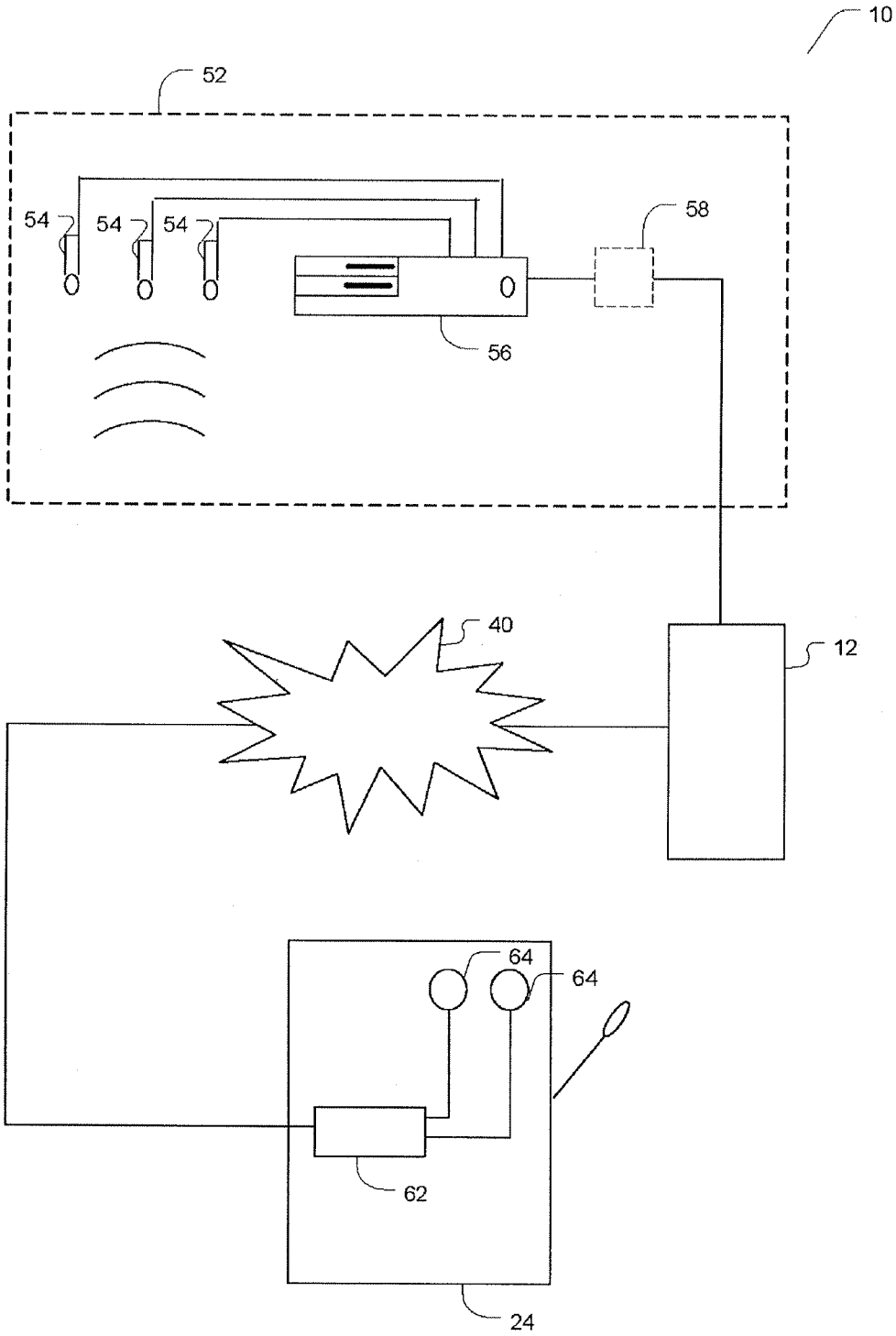
FIG. 1 is an illustration of one embodiment of a centralized audio control system.
Figure 2:
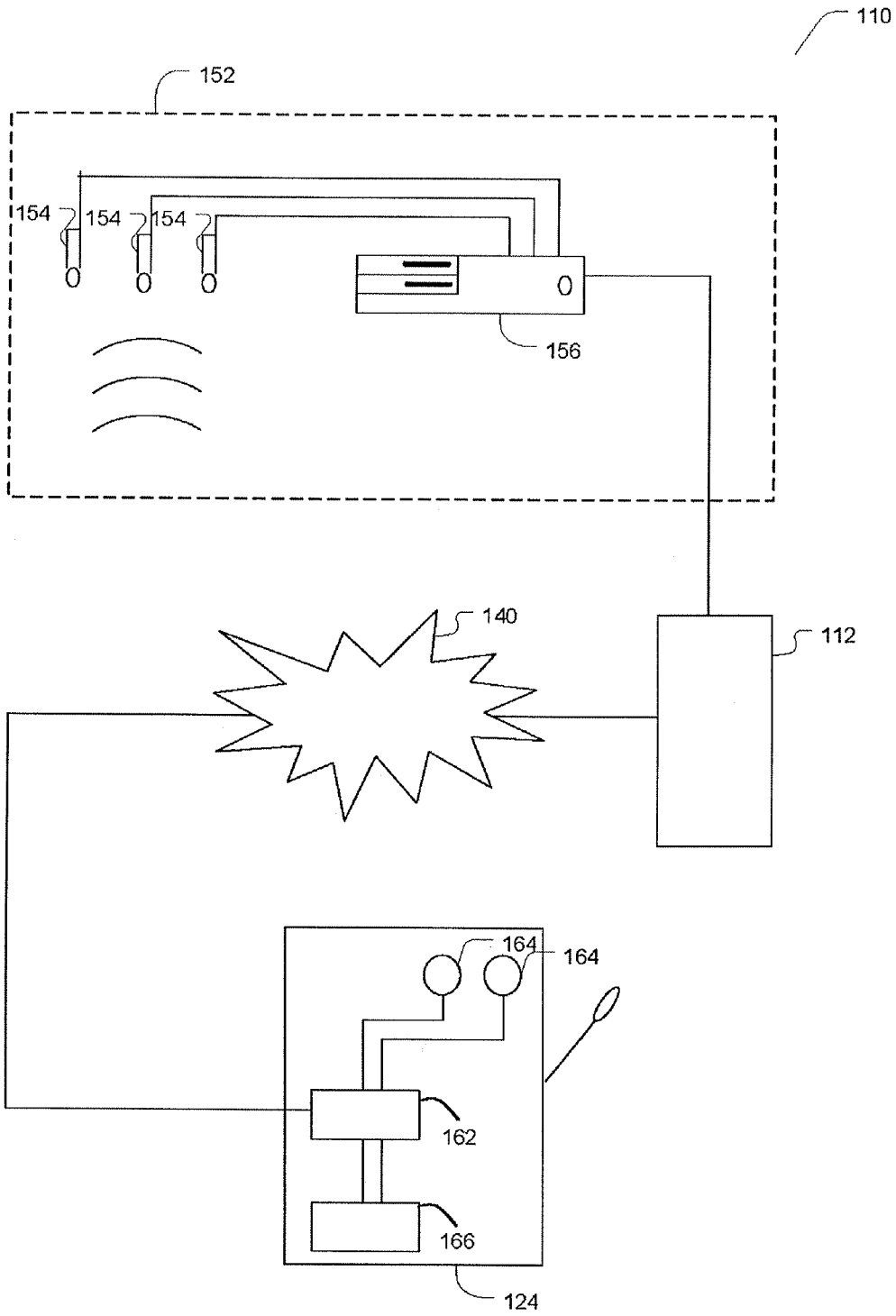
FIG. 2 is an illustration of another embodiment of a centralized audio control system.
Figure 3:
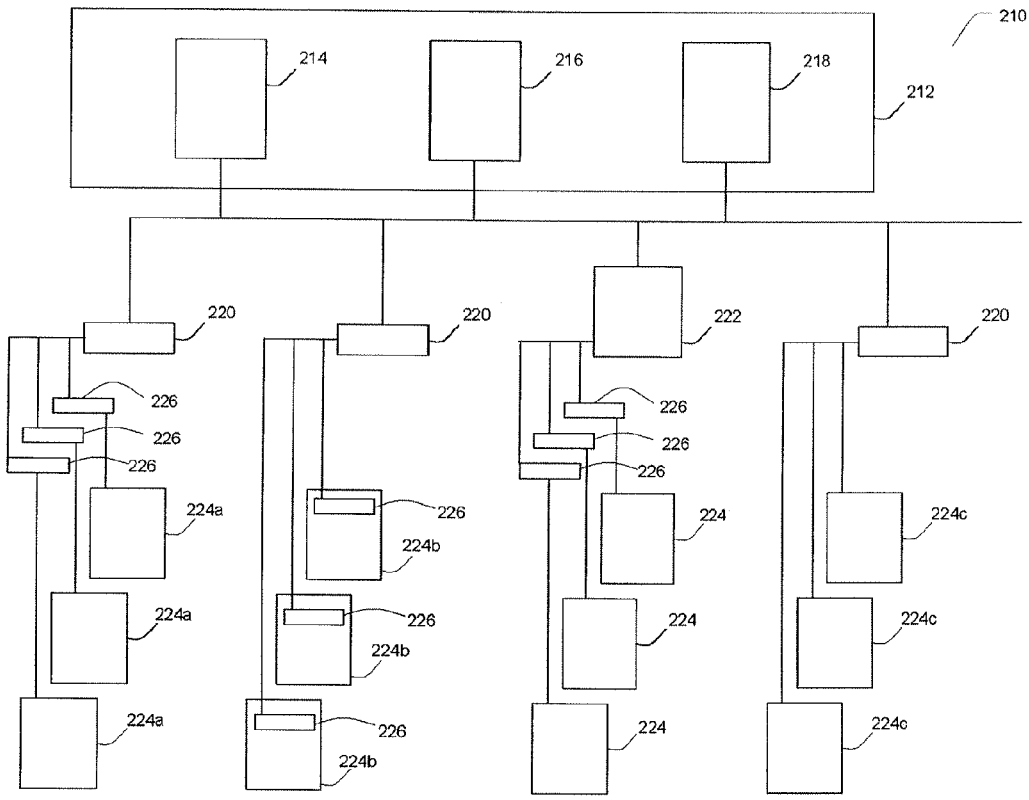
FIG. 3 is a schematic illustration of a casino gaming system for use in accordance with an embodiment of a centralized audio control system.

Referring now to the drawings, wherein like reference numerals denote like or corresponding parts throughout the drawings and, more particularly to FIGS. 1-3, there are shown various embodiments of a centralized audio control system.

Referring to FIG. 1, a centralized audio control system 10 for providing centralized control of the audio output for one or more gaming machines in a casino gaming network is shown. The centralized audio control system 10 comprises a noise level detector 52 connected to the system server 12. The system server 12 is connected to one or more gaming machines 24 through the casino floor network 40.

The noise level detector 52 obtains noise level data from the casino gaming floor and/or surrounding areas. More particularly, in one embodiment, the noise level detector 52 monitors the ambient noise level, or the constant level of noise, on the casino gaming floor. The ambient noise on a casino floor includes, but is not limited to, the interaction of customers and employees, media presentations (such as the sound emitted from bar television sets and performers), and the chatter of gaming devices either luring players to them or encouraging them to stay and play.

In one embodiment, the noise level detector 52 comprises one or more microphones 54 strategically placed around the casino gaming area to capture noise level data. One or more microphones 54 may be positioned at or near the ceiling, on the floor, against a wall, and/or on a gaming machine. Alternatively, the microphones 54 may be placed within, or among, a bank of gaming machines. As those skilled in the art will appreciate, the microphones 54 may be placed anywhere on the casino gaming floor. As those skilled in the art will appreciate, a variety of microphones may be used in the centralized audio control system 10.

Referring back to FIG. 1, the microphones 54 are operatively connected to a microphone interface 56. In one embodiment, the microphone interface 56 is a single board computer (SBC) that is capable of collecting and storing noise level data. The noise level data is then sent to the system server 12 for further analysis. Alternatively, the SBC can process the audio data before the data is sent to the system server 12.

Optionally, in another embodiment, the microphone interface 56 is operatively connected to an ambient interface 58. The ambient interface 58 is capable of monitoring and averaging the casino noise level. The ambient interface 58 may also be capable of processing and analyzing the collected noise level data. For example, the ambient interface 58 may apply normalizing techniques to the collected data to average the noise level data. As those skilled in the art will appreciate other signal-processing procedures may be applied to the data. After processing the noise level data, the ambient interface 58 may send the resulting data to the system server 12. Alternatively, the microphone interface 56 may bypass the processing of the collected noise level data, and may instead send raw noise level data to the system server 12 for processing. Optionally, in another embodiment, both the ambient interface 58 and the system server 12 apply processing techniques to the collected noise level data.

Alternatively, in another embodiment, the microphone interface 56 is a sophisticated device comprising at least one processor and software for monitoring noise levels. The sophisticated microphone interface 56 is capable of collecting noise level data, analyzing the collected data and normalizing the collected data. In addition, the microphone interface 56 may include a sound processor for performing further detailed analysis of the collected data and as well as more processing of the collected noise level data. The collected noise level data is then sent to the system server 12. Optionally, in another embodiment, the noise level data is not processed or analyzed by the microphone interface 56 and is instead sent to the system server 12 for processing.

Once the system server 12 receives the noise level data, it analyzes the data and determines an appropriate audio output for one or more of the gaming machines 24 connected to the casino gaming network. The appropriate audio output is based on a set of pre-determined rules established by the casino or manufacturer. These pre-determined rules may vary between casinos. Furthermore, casino operators are able to specify or alter the audio output rules. For example, the casino may want gaming machine volume levels to be louder in the morning and quieter in the evening. Alternatively, the casino may want gaming machine audio levels to be at a particular volume during peak hours and at a different volume during off-peak hours. Additionally, the casino can set minimum and maximum audio levels for the gaming machines 24. Alternatively, the casino may establish audio rules for individual gaming machines and optionally, the casino may establish rules for subsets of gaming machines. Specifically, the casino can organize gaming machines into subsets according to their physical placement on the casino floor. Different subsets may have a different set of rules. For example, a subset of gaming machines located near the bar may have a first set of audio rules, while a subset of gaming machines located near the stage may have a second set of rules. Factors such as gaming machine placement, patron traffic, and machine usage may affect the desired audio level of the gaming machines.

The appropriate audio output may relate to not only volume levels but also sound types, such as but not limited to, music, melodies, sound effects, spoken-words, and the like. For example, the system server 12 may determine the appropriate volume level for one or more gaming machines 24. Additionally, the system server 12 may determine the appropriate type of sound for the gaming machine 24 to output from its speakers 64. Various sound files may be stored on the gaming machine 24, the game monitoring unit (GMU) (not shown) or the system server 12. The system server 12 can send instructions pertaining to sound type and storage location of a particular sound file.

In another embodiment, the system server 12 may send one or more sounds files to a plurality of gaming machines. The sound files may be the same sound file or different sound files. In one embodiment, the different sounds files are related so that a group of gaming machines may produce a Doppler sound effect. That is, the system server 12 may send sequential sound files to adjacent gaming machines in order to produce a Doppler sound effect among a bank of gaming machines. Alternatively, a sound file may be sent to one gaming machine to produce a Doppler sound effect on the machine.

Referring back to FIG. 1, the system server 12 is connected to one or more gaming machines 24 by a casino floor network 40. The casino floor network may comprise a plurality of gaming machines, kiosks, routers, bridges, and Ethernet connections. In the embodiment shown in FIG. 1, the gaming machine 24 includes an audio hub 62 coupled to one or more speakers 64. According to one embodiment, the audio hub 62 is a sound card that receives instructions regarding audio levels, sound type, storage location of a particular sound file, or a combination thereof. In another embodiment, the audio hub 62 is a microprocessor unit having a sound card.

In one embodiment, the audio hub 62 may include a switch to manually control the volume of the audio output in the event the system server 12 is not operational. According to one embodiment, the audio output may be manually controlled with a graduated volume knob. Alternatively, a digital display may be included with the volume knob wherein the display shows the volume level in decibels or other audio measurement units. In yet another embodiment, the audio hub 62 may be operatively connected to other system components including by way of example, but not by way of limitation, a game management unit (GMU) (not shown). Accordingly, the audio output of one or more gaming machines 24 may be controlled by the GMU should the system server 12 become inoperable.

According to one embodiment, the audio hub 62 is operatively connected to an amplifier (not shown). In another embodiment, the amplifier may be integrated into the audio hub. In other embodiments, the audio hub 62 may be operatively connected to other audio components such as, but not limited to, an equalizer, mixer, and the like.

In one embodiment, the speakers 64 are coupled to the audio hub via an amplifier. Alternatively, speakers 64 may be self-amplified. Optionally, the speakers 64 may be component speakers with separate tweeter, midrange, and subwoofer to provide better sound imaging to the gaming machine patron. In yet another embodiment, the speakers 64 may be full range speakers (e.g., two-way, three-way, or four-way speakers).

Referring now to FIG. 2, another embodiment of a centralized audio control system 110 is shown. This embodiment of the centralized audio control system is similar to the system of FIG. 1 except that the audio hub 162 is retrofitted into an existing gaming machine 124. In this embodiment, the audio hub 162 is coupled to an amplifier 166 in the gaming machine and the speakers 164. The audio hub 162 receives instructions from the system server 112 regarding audio levels, sound type, storage location of a particular sound file, or a combination thereof. The audio hub 162 is then able to execute the instructions from the system server 112. For example, the volume level may be lowered or raised based upon the instructions from the system server 112. Additionally, new sound types sent by the system server 112 may be played on the gaming machine 124.

Referring back to FIG. 1, in an optional embodiment, the audio hub 62 is located in a first gaming machine 24 and is connected to one or more additional gaming machines 24 (not shown). In this optional embodiment, the audio hub 62 receives audio instructions from the system server and is configured to adjust the audio output for one or more gaming machines.

Referring to FIG. 3, a casino gaming system 210 that may incorporate a centralized audio control system is shown. The casino gaming system 210 comprises a server system 212, network bridges 220, a network rack 222, gaming machines 224 and game management units 226 all connected via a system network.

A variety of types of servers may be used as the system server 212. The type of server used is generally determined by the platform and software requirements of the gaming system. Additionally, the system server 212 may be configured to comprise multiple servers. In one embodiment, as illustrated in FIG. 3, the server system 212 is configured to include three servers. Specifically, servers 214, 216 and 218 form the server system 212, or the backend servers. In one example, server 214 is a Windows® based server, server 216 is an IBM RS6000 based server, and server 218 is an IBM AS/400 based server. Of course, one of ordinary skill in the art will appreciate that different types of servers may also be used. The server system 212 performs several fundamental functions. For example, the server system 212 can collect data from the slot floor as communicated to it from other network components, and maintain the collected data in its database. The server system 212 may use slot floor data to generate a report used in casino operation functions. Examples of such reports include, but are not limited to, accounting reports, security reports, and usage reports. The system server 212 may also pass data to another server for other functions. Alternatively, the system server 212 may pass data stored on its database to floor hardware for interaction with a game or slot player. For example, data such as a game player's name or the amount of a ticket being redeemed at a game may be passed to the floor hardware. Additionally, the system server 212 may comprise one or more data repositories for storing data. Examples of types of data stored in the system server data repositories include, but are not limited to, information relating to individual player play data, individual game long-term accounting data, cashable ticket data, sound data including optimum audio outputs for various casino settings.

The network bridges 220 and network rack 222 shown in FIG. 3 are networking components. These networking components, which may be classified as middleware, facilitate communications between the system server 212 and the game management units 226. The network bridges 220 concentrate the many game management units 226 (2,000 on average) into a fewer number (nominally 50:1) of connections to the system server 212. Additionally, the network rack 222 may also concentrate game management units 226 into a fewer number (2000:1) of connections to the system server 212. The network bridges 220 and network rack 222 may comprise data repositories for storing network performance data. Such performance data may be based on network traffic and other network related information. Optionally, the network bridge 220 and the network rack 222 may be interchangeable components. For example, in one embodiment, a casino gaming system may comprise only network bridges and no network racks. Alternatively, in another embodiment, a casino gaming system may comprise only network racks and no network bridges. Additionally, in an alternative embodiment, a casino gaming system may comprise any combination of one or more network bridges and one or more network racks.

The gaming machines 224 illustrated in FIG. 3 act as terminals for interacting with a player playing a casino game. In various embodiments, the gaming machines 224 may be a mechanical reel spinning slot machine, video slot machine, video poker machine, keno machine, video blackjack machine, or any gaming machine offering one or more of the above described games. Additionally, each gaming machine 224 may comprise one or more data repositories for storing data. Examples of information stored by the gaming machines 224 include, but are not limited to, maintenance history information, long-term play data, real-time play data and sound data. The sound data may include, but is not limited to, audio files, sound clips, way files, mp3 files and sound files saved in various other formats. Furthermore, each gaming machine 224 comprises an audio system (not shown) for outputting sound. Typically, the audio system comprises one or more speakers, an amplifier, and access to one or more sound files.

Game management units (GMUs) connect gaming machines to network bridges. The function of the GMU is similar to the function of a network interface card connected to a desktop personal computer (PC). Referring to FIG. 3, a GMU 226 connects a gaming machine 224 to the network bridge 220. Some GMUs have much greater capability and can perform such tasks as calculating a promotional cash-back award for a player, generating a unique ID for a cash redeemable ticket, and storing limited amounts of game and transaction based data. Some GMUs may comprise one or more data repositories for storing data. The types of data stored by the GMUs may include, but is not limited to, real-time game data, communication link performance data, real-time player play data and sound data including sound files and audio clips.

In one embodiment, the GMU 226 is a separate component located outside a gaming machine 224*a*. Alternatively, in another embodiment, the GMU 226 is located within a gaming machine 224*b*. Optionally, in an alternative embodiment, one or more gaming machines 224*c* connect directly to a network bridge 220 and are not connected to a GMU 226.

Of course, one of ordinary skill in the art will appreciate that a casino gaming system may also comprise other types of components, and the above illustration is meant only as an example and not as a limitation to the types of components used in a casino gaming system.

The various embodiments described above are provided by way of illustration only and should not be construed to limit the invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A system for providing centralized control of the audio output for one or more gaming machines in a casino gaming network, the system comprising:

one or more microphone interfaces positioned in a casino gaming floor environment to obtain noise level data;

an ambient interface connected to the microphone interface, wherein the ambient interface monitors, analyzes, and averages the ambient casino noise level;

a system server connected to the microphone interface and the ambient interface, wherein the system server receives the obtained noise level data and determines the appropriate audio output for one or more gaming machines, wherein the appropriate audio output for the one or more gaming machines is determined with respect to the monitored casino noise level, and wherein the system server sends sequential sound files to a group of adjacent gaming machines and enables the group of adjacent gaming machines to produce a Doppler sound effect; and an audio hub positioned within each gaming machine and connected to the system server, wherein each audio hub receives audio instructions from the system server and adjusts the audio output for one or more gaming machines.

2. The system of claim 1, wherein the received audio instructions relate to sound type and the audio hub adjusts the volume level of only one type of sound output from the gaming machine, and wherein the types of sound output from the gaming machine include music, melodies, sound effects, or spoken-words.

3. The system of claim 1, wherein the received audio instructions relate to one or more sound effects and the audio hub adjusts the sound effects output from the gaming machine.

4. The system of claim 1, wherein the system server sends the same audio instructions to more than one audio hub thereby producing the same audio output in more than one gaming machine.

5. The system of claim 1, wherein the system server sends audio instructions to more than one audio hub.

6. The system of claim 1, wherein the audio hub is in communication with one or more speakers.

7. The system of claim 6, wherein the speakers are self-amplified, component speakers, or full-range speakers.

8. The system of claim 6, wherein the audio hub is in communication with an amplifier, equalizer, mixer, or a combination thereof.

9. The system of claim 1, wherein the audio hub includes a manual volume control knob.

10. A method for centrally controlling the audio output of one or more gaming machines in a casino game networking system, the method comprising:

providing a microphone interface having a processor that is connected to noise level detectors, wherein the microphone interface monitors the casino noise level, collects noise level data, and analyzes the collected data using the processor;

capturing noise level data from noise level detectors positioned in a casino gaming floor environment;

analyzing the captured noise level data with the microphone interface connected to the noise level detectors and storing the casino noise level data in the microphone interface;

determining the appropriate audio output for one or more gaming machines with a system server connected to the microphone interface, wherein the appropriate audio output for the one or more gaming machines is determined with respect to the captured casino noise level data, and wherein the system server sends sequential sound files to a group of adjacent gaming machines and enables the group of adjacent gaming machines to produce a Doppler sound effect; and sending instructions for adjusting the audio output of one or more gaming machines from the system server to an audio hub positioned within each gaming machine and connected to the system.

11. The method of claim 10, wherein the noise level data is captured from one or more microphones.

12. The method of claim 10, further comprising sending audio effects to one or more gaming machines, wherein the audio effects are music, melodies, sound effects, spoken-words, or a combination thereof.

13. A system for providing centralized control of the audio output for one or more gaming machines in a casino gaming network, the system comprising:

one or more microphone interfaces positioned in a casino gaming floor environment to obtain noise level data, wherein the microphone interfaces monitor the casino noise level, collect noise level data, and analyze the collected data;

a system server connected to the microphone interface to receive the obtained noise level data and to determine the appropriate audio output for one or more gaming machines, wherein the appropriate audio output for the one or more gaming machines is determined with respect to the averaged casino noise level; and an audio hub positioned within each gaming machine and connected to the system server, wherein each audio hub receives audio instructions from the system server and adjusts the audio output for one or more gaming machines.

14. The system of claim 13, wherein one or more microphones are positioned on the ceiling of the casino gaming floor environment.

15. The system of claim 13, wherein one or more microphones are positioned on one or more walls of the casino gaming floor environment.

16. The system of claim 13, wherein one or more microphones are positioned on or near a gaming machine.

17. The system of claim 13, wherein the received audio instructions relate to an appropriate sound level and the audio hub adjusts the volume level of the gaming machine.

18. The system of claim 13, wherein the received audio instructions relate to sound type and the audio hub adjusts the type of sound output from the gaming machine.

19. The system of claim 13, wherein the received audio instructions relate to one or more sound effects and the audio hub adjusts the sound effects output from the gaming machine.

20. The system of claim 13, wherein the system server sends the same audio instructions to more than one audio hub thereby producing the same audio output in more than one gaming machine.

21. The system of claim 13, wherein the system server sends audio instructions to more than one audio hub.

22. The system of claim 13, wherein the audio hub is in communication with one or more speakers.

23. The system of claim 22, wherein the speakers are self-amplified, component speakers, or full-range speakers.

24. The system of claim 22, wherein the audio hub is in communication with an amplifier, equalizer, mixer, or a combination thereof.

25. The system of claim 13, wherein the audio hub includes a manual volume control knob.

* * * * *

UNITED STATES PATENT AND TRADEMARK OFFICE

CERTIFICATE OF CORRECTION

PATENT NO. : 8,517,833 B2
APPLICATION NO. : 13/078613
DATED : August 27, 2013
INVENTOR(S) : Paul R. Osgood It is certified that error appears in the above-identified patent and that said Letters Patent is hereby corrected as shown below:

In the Specification
Column 6
Line 52. Change “way” to -wav-

Signed and Sealed this
Twenty-second Day of October, 2013

Teresa Stanek Rea
*Deputy Director of the United States Patent and Trademark Office*